US008517196B2

(12) United States Patent
Chang

(10) Patent No.: US 8,517,196 B2
(45) Date of Patent: Aug. 27, 2013

(54) POSITIONING STRUCTURE FOR A CLIPBOARD

(76) Inventor: Chun Yuan Chang, Taipei (TW)

( * ) Notice: Subject to any disclaimer, the term of this patent is extended or adjusted under 35 U.S.C. 154(b) by 61 days.

(21) Appl. No.: 13/109,014

(22) Filed: May 17, 2011

(65) Prior Publication Data

US 2012/0292312 A1 Nov. 22, 2012

(51) Int. Cl.
*B65D 6/28* (2006.01)
*B65D 45/16* (2006.01)
*B42F 1/02* (2006.01)

(52) U.S. Cl.
USPC ..... 220/4.22; 220/6; 220/7; 220/324; 220/520; 220/835; 24/67.3; 24/67.11; 206/451; 281/45

(58) Field of Classification Search
USPC ..... 24/67 R, 67.11, 67.3, 67.7, 67.9; 206/425, 449, 451, 555; 220/4.21–4.25, 220/6, 7, 23.86, 324, 520, 835; 281/42, 45
See application file for complete search history.

(56) References Cited

U.S. PATENT DOCUMENTS 291,499 A * 1/1884 De Vox ..... 40/358
302,774 A * 7/1884 Polkinhorn ..... 312/231
491,011 A * 1/1893 Dom ..... 24/67.7
1,133,979 A * 3/1915 Lee ..... 312/190
1,203,659 A * 11/1916 Smith ..... 248/456
1,290,811 A * 1/1919 Ware ..... 33/429
1,426,632 A * 8/1922 Hachmann ..... 281/17
1,453,658 A * 5/1923 Clough ..... 40/647
1,642,384 A * 9/1927 Pryor ..... 281/45
1,642,385 A * 9/1927 Pryor ..... 281/45
1,735,318 A * 11/1929 Huey ..... 281/45
1,953,887 A * 4/1934 Medoff ..... 206/37
1,967,632 A * 7/1934 Simonson ..... 281/45
2,243,535 A * 5/1941 Newman ..... 402/37
2,347,278 A * 4/1944 Pitt ..... 24/67.11
2,500,468 A * 3/1950 Postell ..... 24/67.7
2,547,167 A * 4/1951 Nielsen ..... 312/190
2,606,774 A * 8/1952 Zalkind ..... 312/190
2,806,715 A * 9/1957 Smith ..... 281/44
2,850,296 A * 9/1958 Ratliff ..... 220/527
2,907,584 A * 10/1959 Neilsen ..... 281/44
3,236,242 A * 2/1966 Galiley ..... 402/22
3,297,862 A * 1/1967 Levy et al. ..... 362/99
3,612,709 A * 10/1971 Miyamoto ..... 402/2
3,711,899 A * 1/1973 Shelton et al. ..... 24/67.7
3,775,870 A * 12/1973 Griggs et al. ..... 206/472
3,891,070 A * 6/1975 Montanari ..... 190/117

(Continued)

*Primary Examiner* — J. Gregory Pickett
*Assistant Examiner* — Ned A Walker
(74) *Attorney, Agent, or Firm* — Alan Kamrath; Kamrath IP Lawfirm, P.A.

(57) ABSTRACT

A positioning structure for a clipboard contains a first cover and a second cover. Two grooves are formed on a connection of the first cover and the second cover. The first cover includes two first recesses, and the second cover includes two second recesses, two retainers are attached in the two first recess and the two second recess. The first cover also includes a first slot, a second slot, and a third slot. The second cover also includes a first notch, a second notch, and a third notch. Each of plural positioning members includes an integrally formed abutting block, an actuating section, a first inserting piece, two second inserting pieces, and a cutout. The plural positioning members are inserted in or removed from the first slot, the second slot, the third slot, the first notch, the second notch, the third notch by using a plurality of first inserting pieces.

2 Claims, 7 Drawing Sheets

(56) References Cited

U.S. PATENT DOCUMENTS

| | | | | | |
|---|---|---|---|---|---|
| 3,954,287 | A | * | 5/1976 | Osteen | 281/15.1 |
| 3,977,744 | A | * | 8/1976 | DeWitt | 312/231 |
| 4,114,240 | A | * | 9/1978 | Nackenson | 24/67.11 |
| 4,243,249 | A | * | 1/1981 | Goss | 281/51 |
| D261,903 | S | * | 11/1981 | Mulder | D19/88 |
| 4,340,316 | A | * | 7/1982 | Jahn | 402/68 |
| 4,396,209 | A | * | 8/1983 | Schultz | 281/45 |
| 4,445,728 | A | * | 5/1984 | Bratton | 312/1 |
| 4,470,620 | A | * | 9/1984 | Gerch | 281/31 |
| 4,496,058 | A | * | 1/1985 | Harris et al. | 40/308 |
| 4,555,128 | A | * | 11/1985 | White et al. | 281/45 |
| 4,577,788 | A | * | 3/1986 | Richardson | 224/483 |
| 4,628,572 | A | * | 12/1986 | Chang | 24/67.11 |
| 4,763,389 | A | * | 8/1988 | Chang | 24/67.11 |
| 4,765,768 | A | * | 8/1988 | Wright | 402/30 |
| 4,787,595 | A | * | 11/1988 | Hegarty | 248/454 |
| 4,883,381 | A | * | 11/1989 | Pisciotti et al. | 402/74 |
| 4,892,334 | A | * | 1/1990 | Sinclair | 281/45 |
| 4,896,927 | A | * | 1/1990 | Liu et al. | 312/190 |
| 4,899,974 | A | * | 2/1990 | Wear et al. | 248/467 |
| 4,949,850 | A | * | 8/1990 | Weathers | 211/69.7 |
| 4,968,258 | A | * | 11/1990 | Kees | 434/370 |
| 4,997,088 | A | * | 3/1991 | Spry | 206/449 |
| 5,028,075 | A | * | 7/1991 | Donnelly | 281/49 |
| D328,102 | S | * | 7/1992 | Buzak | D19/92 |
| 5,163,748 | A | * | 11/1992 | Messinger | 362/98 |
| 5,174,607 | A | * | 12/1992 | Hill | 281/45 |
| 5,180,133 | A | * | 1/1993 | Chang | 248/452 |
| 5,226,215 | A | * | 7/1993 | Evenson | 24/67.5 |
| 5,312,082 | A | * | 5/1994 | Chang | 248/452 |
| 5,388,530 | A | * | 2/1995 | Jacobus | 108/43 |
| 5,407,512 | A | * | 4/1995 | Policht | 156/247 |
| 5,474,333 | A | * | 12/1995 | Schrader | 281/45 |
| 5,590,910 | A | * | 1/1997 | Meth | 281/45 |
| 5,599,189 | A | * | 2/1997 | Kees | 434/370 |
| 5,671,951 | A | * | 9/1997 | Palmiter et al. | 281/31 |
| 5,774,946 | A | * | 7/1998 | Morgan | 24/67.5 |
| 5,810,316 | A | * | 9/1998 | Eby | 248/451 |
| 5,823,500 | A | * | 10/1998 | La Coste | 248/444 |
| 5,975,576 | A | * | 11/1999 | Vogel | 281/16 |
| D424,120 | S | * | 5/2000 | Wear | D20/43 |
| 6,076,990 | A | * | 6/2000 | Jahn | 402/70 |
| 6,217,075 | B1 | * | 4/2001 | Tsai | 281/45 |
| 6,234,701 | B1 | * | 5/2001 | Karten et al. | 402/73 |
| 6,347,810 | B1 | * | 2/2002 | Dottel | 281/29 |
| 6,367,642 | B2 | * | 4/2002 | Kambouris et al. | 220/4.22 |
| 6,419,416 | B1 | * | 7/2002 | Tomoda | 402/18 |
| 6,450,471 | B1 | * | 9/2002 | Wear | 248/489 |
| 6,637,774 | B2 | * | 10/2003 | Gaska | 281/45 |
| 6,663,310 | B2 | * | 12/2003 | Han | 402/8 |
| 6,666,608 | B1 | * | 12/2003 | Chen | 402/58 |
| 6,672,622 | B2 | * | 1/2004 | Barron | 281/44 |
| 6,846,090 | B1 | * | 1/2005 | Smith | 362/99 |
| 6,860,573 | B2 | * | 3/2005 | Dunn et al. | 312/100 |
| 6,866,516 | B2 | * | 3/2005 | Smith et al. | 434/408 |
| 6,883,769 | B2 | * | 4/2005 | Shamoon | 248/447 |
| 7,097,378 | B2 | * | 8/2006 | Peleman | 402/18 |
| 7,102,516 | B2 | * | 9/2006 | Orman | 340/570 |
| 7,374,143 | B1 | * | 5/2008 | Wittke | 248/444.1 |
| D575,826 | S | * | 8/2008 | Chen et al. | D19/88 |
| 7,445,246 | B1 | * | 11/2008 | Wagschal et al. | 281/45 |
| D586,400 | S | * | 2/2009 | Shamoon | D19/88 |
| 7,513,708 | B2 | * | 4/2009 | Cheng et al. | 402/75 |
| 7,654,765 | B2 | * | 2/2010 | Cheng | 402/75 |
| D611,543 | S | * | 3/2010 | Chen et al. | D19/88 |
| 7,736,012 | B1 | * | 6/2010 | Chu et al. | 362/98 |
| 7,757,358 | B2 | * | 7/2010 | Hoarau et al. | 24/67 R |
| 7,845,611 | B1 | * | 12/2010 | Sholander | 248/444.1 |
| 7,918,576 | B2 | * | 4/2011 | Leanza | 362/99 |
| 7,992,712 | B2 | * | 8/2011 | Rosland | 206/449 |
| 8,006,354 | B2 | * | 8/2011 | Cheng | 24/67.5 |
| 2001/0000901 | A1 | * | 5/2001 | Kambouris et al. | 220/212 |
| 2002/0050028 | A1 | * | 5/2002 | Kumagai | 24/67.11 |
| 2003/0111476 | A1 | * | 6/2003 | Serio, Jr. | 220/835 |
| 2004/0154944 | A1 | * | 8/2004 | Morisset | 206/425 |
| 2007/0241579 | A1 | * | 10/2007 | Chang | 294/138 |
| 2008/0298047 | A1 | * | 12/2008 | Leanza | 362/99 |
| 2010/0116697 | A1 | * | 5/2010 | Gonazlez | 206/216 |
| 2010/0213094 | A1 | * | 8/2010 | McKay | 206/494 |
| 2011/0155617 | A1 | * | 6/2011 | Chang | 206/524.1 |

* cited by examiner

POSITIONING STRUCTURE FOR A CLIPBOARD

BACKGROUND OF THE INVENTION

1. Field of the Invention

The present invention relates to a positioning structure for a clipboard that is capable of positioning at least one positioning member in first and/or second covers based on requirement.

2. Description of the Prior Art

A conventional clipboard includes first and second covers to be closed together, and at least one retainer to retain the first and second covers together. The first and the second covers are made in two different molds respectively, thus increasing production cost.

Moreover, a paper or a catalog is placed in the clipboard, but the paper or the catalog can not be fixed in the clipboard securely.

The present invention has arisen to mitigate and/or obviate the afore-described disadvantages.

SUMMARY OF THE INVENTION

The primary objective of the present invention is to provide a positioning structure for a clipboard that is capable of positioning at least one positioning member in first and/or second covers based on requirement.

Another objective of the present invention is to provide a positioning structure for a clipboard of which first and second covers are integrally formed by using a mold to lower production cost.

To obtain the above objectives, a positioning structure for a clipboard provided by the present invention contains:

a first cover and a second cover, both of which are integrally formed by a mold and correspond to each other, with two grooves formed on a connection of the first and second covers to retain two retaining members respectively so that the clipboard is opened and closed; the first cover including two first recesses disposed on one side thereof, and the second cover including two second recesses fixed on one side thereof individually, with two retainers attached in the first and second recesses so that the first and second covers are locked together by using the retainers individually; the first cover also including a first slot disposed on another side thereof, a second slot fixed on one end side thereof, and a third slot formed on another end side thereof; the second cover also including a first notch disposed on another side thereof, a second notch fixed on one end side thereof, and a third notch formed on another end side thereof;

wherein each positioning member includes an integrally formed abutting block, an actuating section fixed thereon, a first inserting piece extending downward from a rear side of the abutting block, two inserting pieces attached on two sides of the first inserting piece individually, and a cutout formed on the first inserting piece.

DETAILED DESCRIPTION OF THE PREFERRED EMBODIMENTS

Figure 1:
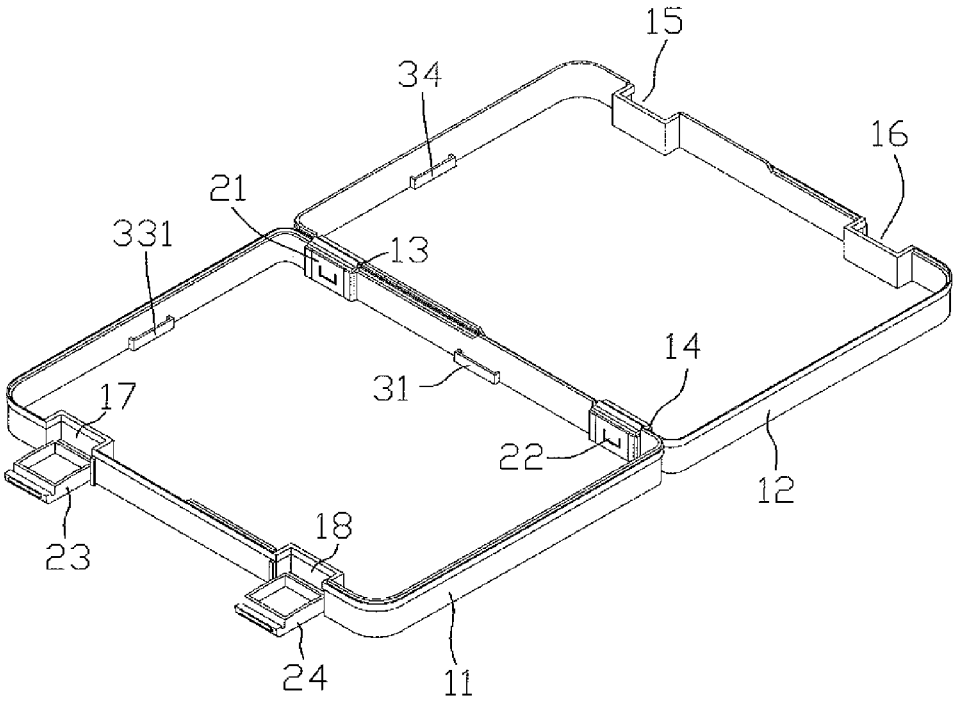
FIG. 1 is a perspective view showing the assembly of a clipboard according to a preferred embodiment of the present invention.
Figure 2:
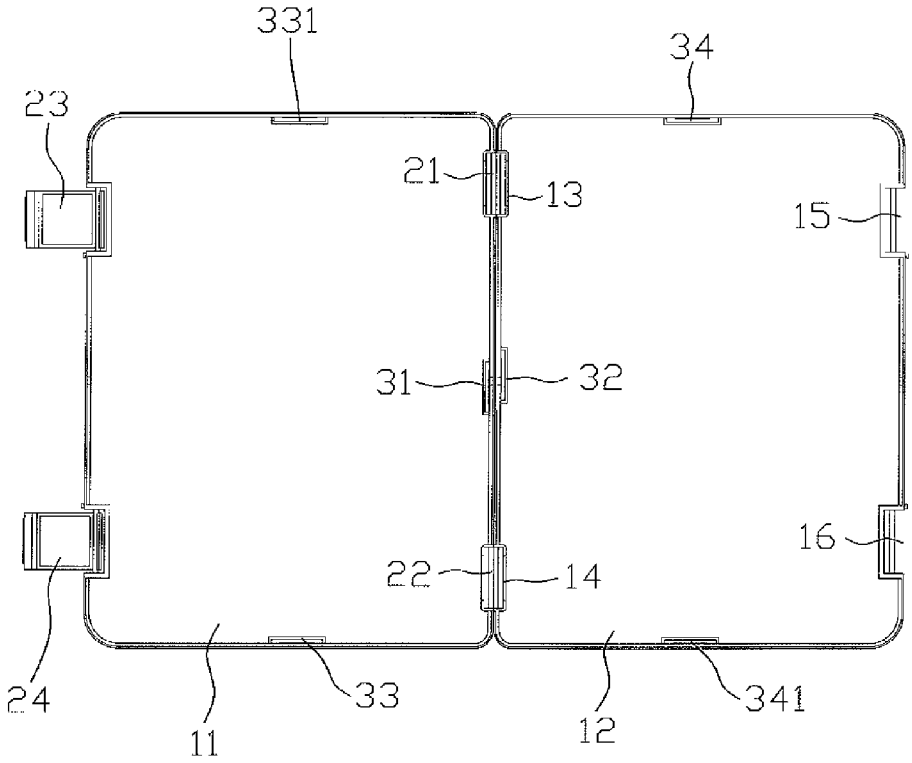
FIG. 2 is a plan view showing the assembly of the clipboard according to the preferred embodiment of the present invention.
Figure 3:
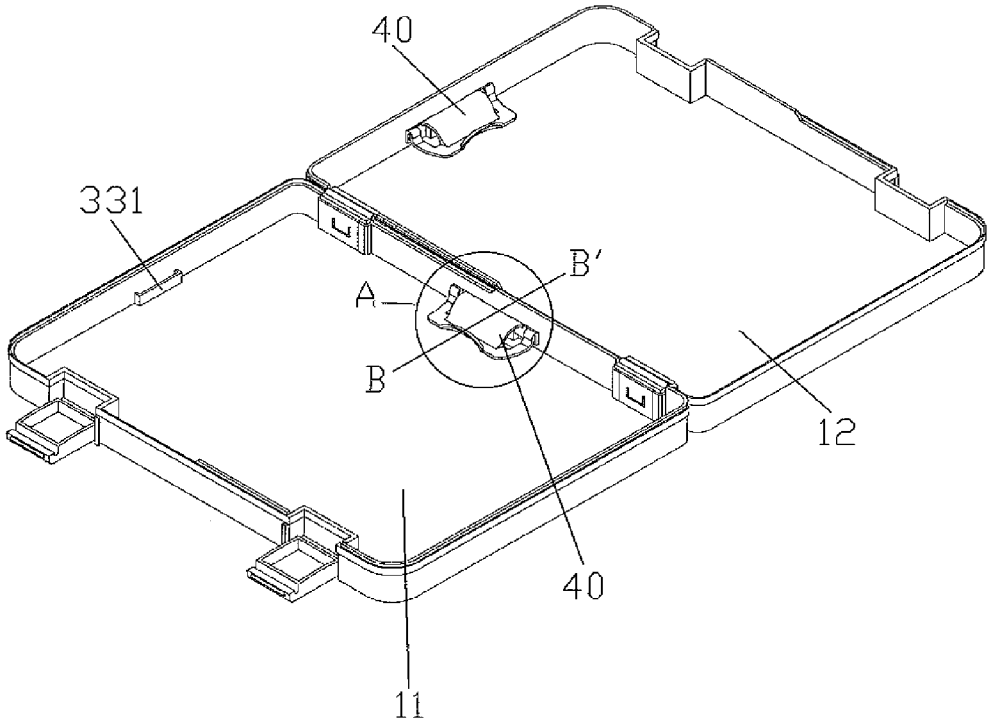
FIG. 3 is a perspective view showing the assembly of a positioning structure for the clipboard according to the preferred embodiment of the present invention.

The present invention will be clearer from the following description when viewed together with the accompanying drawings, which show, for purpose of illustration only, the preferred embodiments in accordance with the present invention.

Referring to FIGS. 1-4, a positioning structure for a clipboard in accordance with a preferred embodiment of the present invention comprises a first cover 11 and a second cover 12, both of which are made by a mold and correspond to each other. Two grooves 13, 14 are formed on a connection of the first and the second covers 11, 12 to retain two retaining members 21, 22 respectively so that the clipboard is opened and closed. The first cover 11 includes two first recesses 17, 18 disposed on a front outer side of the first cover 11, and the second cover 12 includes two second recesses 15, 16 fixed on a rear outer side of the second cover 12. Two retainers 23, 24 are attached in the first and second recesses 17, 18 so that the first and second covers 11, 12 are locked together by using the retainers 23, 24 individually. The first cover 11 also includes a first slot 31 disposed on a rear inner side of the first cover 11, a second slot 331 fixed on a right inner side of the first cover 11, and a third slot 33 formed on a left inner side of the first cover 11. The second cover 12 also includes a first notch 32 disposed on a front inner side of of the second cover 12, a second notch 341 fixed on a left inner side of of the second cover 12, and a third notch 34 formed on a right inner of of the second cover 12.

Figure 4:
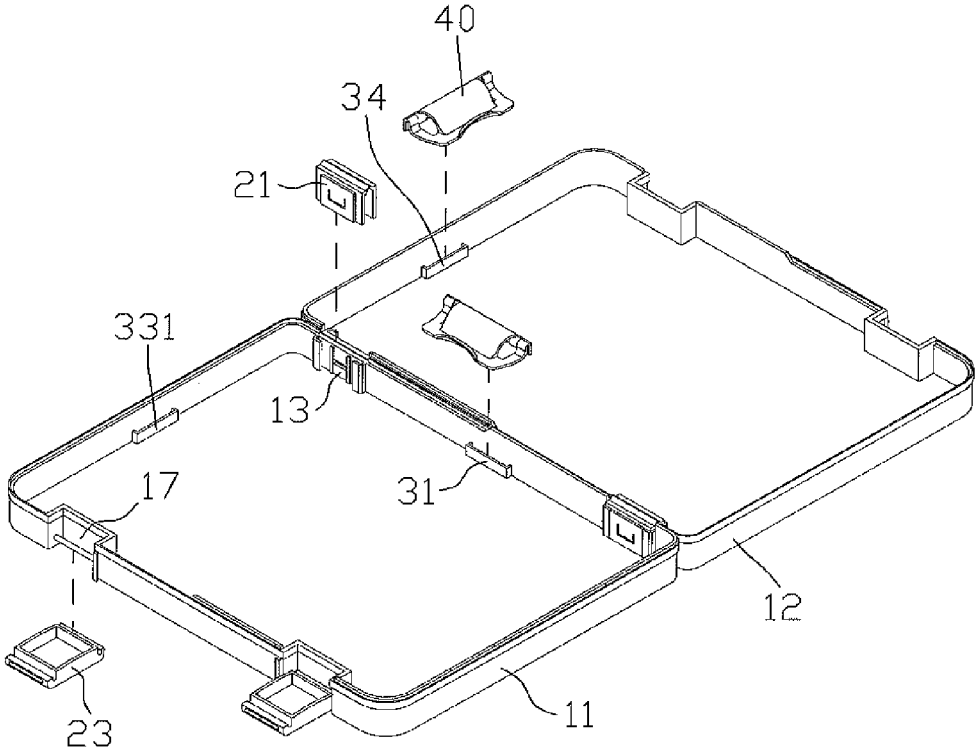
FIG. 4 is an exploded perspective view showing the positioning structure for the clipboard according to the preferred embodiment of the present invention.
Figure 5:
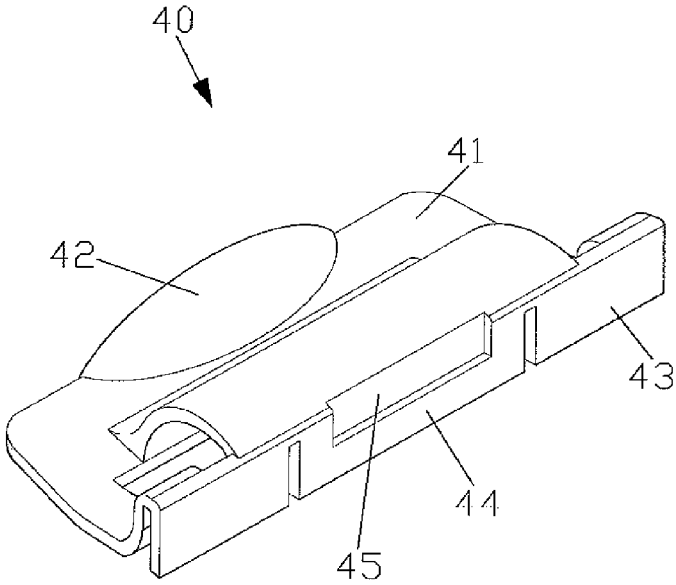
FIG. 5 is a perspective view showing the assembly of a positioning structure for the clipboard according to the preferred embodiment of the present invention.
Figure 6:
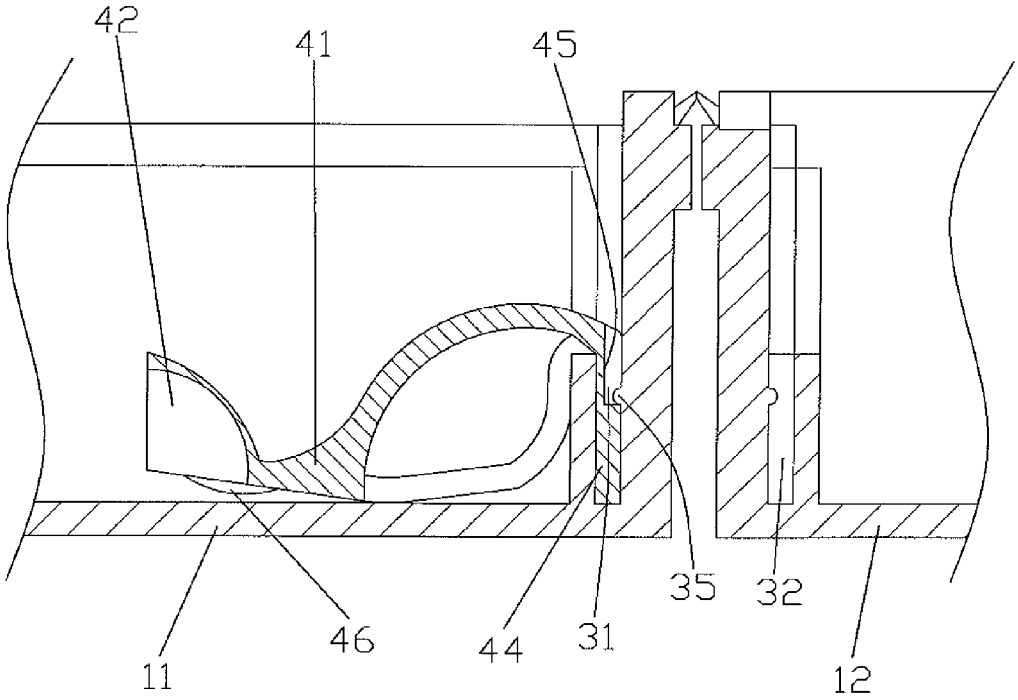
FIG. 6 is an amplified cross sectional of a part A of FIG. 3 and taken along the line B-B' of FIG. 3.

As shown in FIGS. 4-6, the first, second, and third slots 31, 331, 341 of the first cover 11 and the first, second, and third notches 32, 33, 34 of the second cover 12 are integrally formed in the first and second covers 11, 12 respectively to insert at least one positioning member 40. Each positioning member 40 includes an integrally formed abutting block 41, an actuating section 42 fixed thereon, a first inserting piece 44 extending downward from a rear side of the abutting block 41, two inserting pieces 43 attached on two sides of the first inserting piece 44 individually, and a cutout 45 formed on the first inserting piece 44. Thereby when the positioning member 40 is selectively inserted in the first, second, and third slots 31, 331, 341 of the first cover 11 and the first, second, and third notches 32, 33, 34 of the second cover 12, the first inserting piece 44 is placed in the first slot 31, and a horizontal rib 35 of the first slot 31 is retained in the cutout 45 of the first inserting piece 44 to position the positioning member 40 securely. A projection 46 fixed on a bottom end of the positioning members 40 is provided to abut against a document, and the actuating section 42 is used to make a user move the abutting block 41 upward to release an engagement of the document.

Furthermore, the positioning member 4.0 is capable of being engaged with or disengaged from the first, second, and third slots 31, 331, 341 of the first cover 11 and the first, second, and third notches 32, 33, 34 of the second cover 12 selectively.

Figure 7:
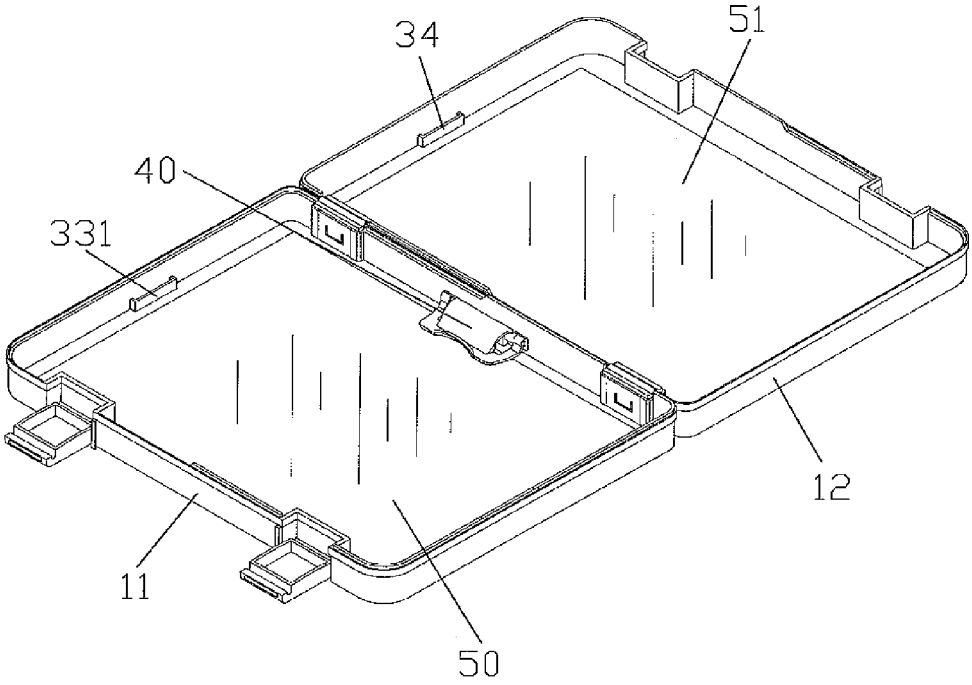
FIG. 7 is a perspective view showing the operation of the positioning structure for the clipboard according to the preferred embodiment of the present invention.

In operation, as shown in FIG. 7, the positioning member 40 is inserted in the first slot 31 of the first cover 11, and there is no positioning member 40 secured in the second cover 12 so that a first paper 50 positioned in the first cover 11 is pressed to be further fixed by ways of the positioning member 40, and second paper 51 of the second cover 12 is placed randomly. Thereafter, as illustrated in FIG. 7, the first slot 31 of the first cover 11 includes the positioning member 40, and the third notch 34 of the second cover 12 also includes another positioning member 40, such that the positioning member 40 is capable of being fixed at any desired position based on requirement. Furthermore, two positioning members 40 are capable of being provided simultaneously so that different formats of documents are taken or read.

While various embodiments in accordance with the present invention have been shown and described, it is clear to those skilled in the art that further embodiments may be made without departing from the scope of the present invention.

What is claimed is:

1. A positioning structure for a clipboard comprising:
- an integrally molded first cover comprising:
  - a front outer side having:
    - two recesses,
    - two locking members respectively disposed within the two recesses;
  - a rear inner side having:
    - a first slot,
    - a second slot; and,
    - a left inner side having a third slot;
- an integrally molded second cover cooperating with the first cover, the second comprising:
  - a front inner side having a first notch;
  - a left inner side having a second notch; and,
  - a right inner side having a third notch;
- a connection member retaining the second cover to the first cover and comprising:
  - two grooves; and,
  - two retaining members respectively disposed in said two groves, the two retaining members enabling the clipboard to be opened and closed;
- a plurality of positioning members, each of the positioning members comprising:
  - an integrally formed abutting block having a rear side;
  - an actuating section;
  - a first inserting piece having two sides and a cutout, the first inserting piece extending downward from the rear side of the abutting block; and,
  - two second inserting pieces respectively attached to the two sides of the first inserting piece;
- wherein a first positioning member of said plurality of positioning members is inserted into the first slot, the second slot, or the third slot; and,
- wherein a second positioning member of said plurality of positioning members is inserted into the first notch, the second notch, or the third notch.

2. The positioning structure for the clipboard as claimed in claim 1, wherein the first slot of the rear inner side of the first cover further comprises a horizontal rib retained within the cutout of the first inserting piece of the first positioning member of said plurality of positioning members.

* * * * *